US005823634A

United States Patent [19]

Pozzobon

[11] Patent Number: 5,823,634

[45] Date of Patent: Oct. 20, 1998

[54] WHEEL, PARTICULARLY FOR SKATEBOARDS OR ROLLERSKATES

[75] Inventor: Alessandro Pozzobon, Paderno Di Ponzano Veneto, Italy

[73] Assignee: Nordica S.p.A., Trevignano, Italy

[21] Appl. No.: 796,330

[22] Filed: Feb. 7, 1997

Related U.S. Application Data

[63] Continuation of Ser. No. 300,536, Sep. 6, 1994, abandoned.

[30] Foreign Application Priority Data

Sep. 10, 1993 [IT] Italy ..... TV93A0083

[51] Int. Cl.[6] ..... B60C 7/10

[52] U.S. Cl. ..... 301/5.3; 301/64.7; 152/11

[58] Field of Search ..... 301/5.3, 5.7, 64.7; 280/11.19, 11.22, 11.23; 152/5, 7, 6, 11, 12, 31, 69, 70, 75, 76, 80, 81, 86

[56] References Cited

U.S. PATENT DOCUMENTS

| | | | |
|---|---|---|---|
| 1,187,042 | 6/1916 | Cherry | 152/31 |
| 1,639,827 | 8/1927 | Wayne | 152/12 X |
| 1,763,580 | 6/1930 | Gauthier | 152/11 |
| 2,277,604 | 3/1942 | Orr | 152/7 |
| 3,895,844 | 7/1975 | Merbler . | |
| 4,208,073 | 6/1980 | Hechinger . | |
| 4,699,432 | 10/1987 | Klamer . | |
| 5,048,848 | 9/1991 | Olson et al. | 301/5.7 X |
| 5,320,418 | 6/1994 | Chen | 301/5.3 |

FOREIGN PATENT DOCUMENTS

| | | | |
|---|---|---|---|
| 2272697 | 12/1975 | France . | |
| 0311902 | 12/1989 | Japan | 152/5 |

*Primary Examiner*—Russell D. Stormer
*Attorney, Agent, or Firm*—Guido Modiano; Albert Josif

[57] ABSTRACT

Wheel, particularly for skateboards or rollerskates, including a central hub with radial spokes, and a tire which is connected to the hub and which has wings arranged in the interspaces delimited by the radial spokes and the central hub. The wings are arranged to only partially fill the interspaces between the spokes such that empty spaces without material are arranged directly adjacent the spokes. The wings may have a degree of rigidity which is different than the rigidity of the outer portion of the tire.

11 Claims, 3 Drawing Sheets

WHEEL, PARTICULARLY FOR SKATEBOARDS OR ROLLERSKATES

This is a continuation of application Ser. No. 08/300,536, filed on Sep. 6, 1994, now abandoned.

BACKGROUND OF THE INVENTION

The present invention relates to a wheel, particularly for skateboards or rollerskates comprising a shoe associated with a frame for supporting a plurality of wheels.

Conventional rollerskates in fact are now usually constituted by a shoe having a sole associated with a frame to which a plurality of wheels are pivoted. The wheels are arranged either in pairs or in line.

In these conventional skates the wheels may have no central hub or may have an open hub with which a tire is associated. The tire interacts directly with the ground.

A problem that arises in the use of these conventional wheels is that the tire has a preset rigidity which may be excessive depending on the track or on the user's technical skill level, thus transmitting considerable vibrations to the frame and therefore to the user's leg.

In contrast, an excessively low rigidity of the tire leads to a rapid wear of the tire, forcing frequent replacement of the entire wheel.

This operation, besides being onerous for the user, is not easy, because it requires particular tools such as for example screwdrivers or adjustable wrenches.

U.S. Pat. No. 4,208,073 discloses a wheel for skateboards and rollerskates which is constituted by a first annular wheel portion, which has a low friction coefficient, and by a second annular wheel portion, which has a high friction coefficient. The annular portions are coaxially associated.

The outer perimetric edges have such a radius so as to facilitate travel of the wheel over rough surfaces.

However, even this solution has drawbacks, because the annular portion which has a low friction coefficient is necessarily relatively rigid and thus transmits directly to the skate frame all the vibrations due to the unevenness of the ground.

In a similar way, the annular portion having a high degree of friction is necessarily relatively soft and thus subject to localized wear.

Furthermore, the high rigidity of the wheel, i.e. of the part which interacts with the ground, does not allow the user to perform maneuvers that entail the separation of the wheel from the ground (a jump), since landing is very violent because the stresses of the impact are fully transmitted to the foot.

SUMMARY OF THE INVENTION

The aim of the present invention is to eliminate the drawbacks described above in conventional wheels by providing a wheel for skates or skateboards which allows the user to select the optimum degree of rigidity of the wheels according to his/her individual requirements and according to the type of track.

Within the scope of this aim, an important object is to provide a wheel that allows to absorb in an optimum manner the vibrations caused by ground roughness or caused by particular maneuvers such as for example jumps.

Another important object is to obtain a wheel which associates with the preceding characteristics that of allowing the user to immediately perceive the selected degree of rigidity and/or the selected degree of vibration damping.

Another important object is to provide a wheel which is structurally simple and easy to industrialize and allows the user to customize the wheel aesthetically.

Another object is to provide a wheel which is reliable and safe in use and has low manufacturing costs.

This aim, these objects and others which will become apparent hereinafter are achieved by a wheel, particularly for skateboards or rollerskates, characterized in that it comprises a tire and a hub, said hub having spokes defining an interspace with said hub, said tire at least partially affecting said interspace.

BRIEF DESCRIPTION OF THE DRAWINGS

Further characteristics and advantages of the invention will become apparent from the detailed description of some particular, but not exclusive, embodiments, illustrated only by way of non-limitative example in the accompanying drawings, wherein.

BRIEF DESCRIPTION OF THE PREFERRED EMBODIMENTS

Figure 1:
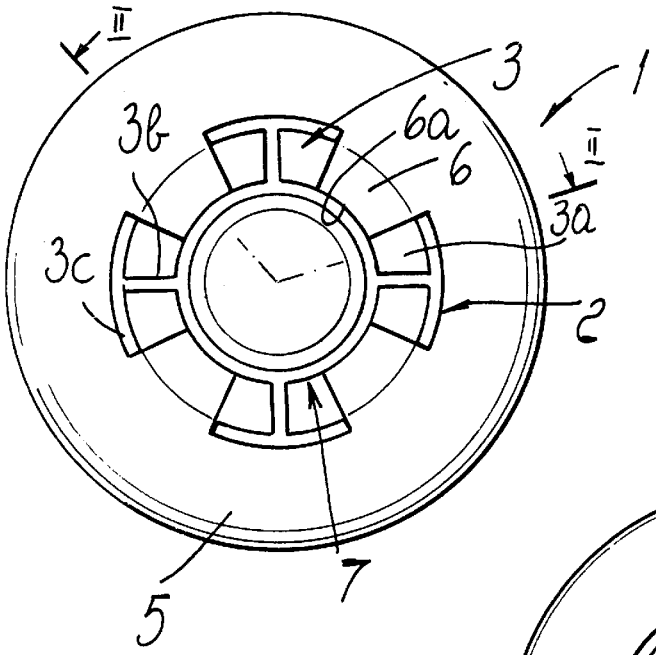
FIG. 1 is a side view of the wheel.

With reference to the above figures, the reference numeral 1 designates a wheel comprising a central hub 2 which has radial spokes 3 and with which it is possible to associate a bearing 4 which is integrated with a pivoting pin (not shown).

The wheel comprises a tire 5 which may partially or fully affect the interspace between the spokes 3 and the central hub 2.

The tire 5 in fact has multiple wings 6 which partially or totally affect the interspace formed between the spokes with respect to the hub or to the seats for the bearing 4.

Figure 2:
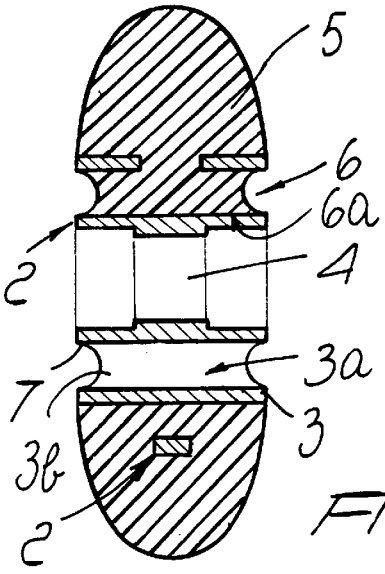
FIG. 2 is a sectional view of the wheel, taken along the plane II—II of FIG. 1.

As shown in FIGS. 1 and 2, wings 6 alternately extend in the spaces and have free ends 6*a* arranged in direct contact with the base or cylindrical wall portion 7 of the central hub 2 that faces them.

The presence of these wings 6 and thus their extension allow to vary the overall rigidity of the tire 5.

As it is clearly shown in FIGS. 1–2, wings 6 partially affect the interspaces between spokes 3 in a manner such that wings 6 are arranged in the interspaces between spokes 3 to partially fill such interspaces, so that there are empty spaces 3*a* without material arranged directly adjacent spokes 3.

The wings 6 can also be made of a different material with respect to the tire 5, or at least with respect to the part thereof which interacts with the ground, so as to allow further damping of the vibrations transmitted from the central hub 2 to the user's leg, and this is achieved simply by using more or less rigid or more or less elastic materials.

In order to facilitate an additional function, which is the absorption and return of the energy due to impact with the ground during maneuvers such as a jump, it is possible to use materials that have different densities and geometries according to the intended elastic response.

For this purpose leaf springs may be used for more rigid use and of elastic bearings for softer use.

Wings 6 can be formed together with the tire 5 or can be interposed between its surface or inner perimetric edge thereof and appropriate seats formed on the central hub.

Figure 2A:
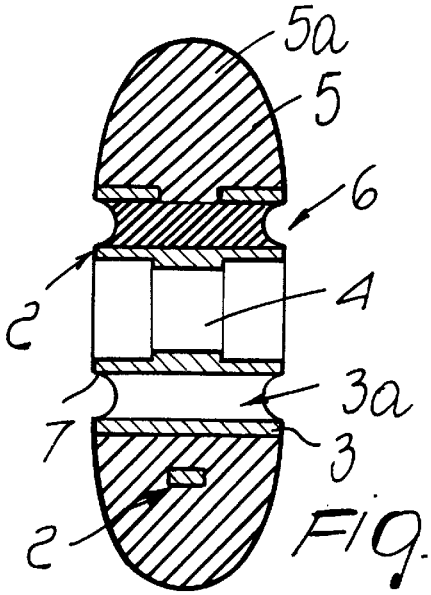
FIG. 2*a* is a view, similar to FIG. 2, of the wheel according to a further aspect of the invention.

FIG. 2*a* shows wings 6 made of a different material than the part or outer portion 5*a* of tire 5 for interaction or rolling contact with the ground. Wings 6 form part of an inner portion of tire 5, and in accordance with the embodiment of FIG. 2*a*, wings 6 may be made of a differ ns material than outer portion 5*a* of tire 5 such that wings 6 have a degree or rigidity which is different than the rigidity of outer portion 5*a* of tire 5. Moreover, as seen from FIGS. 1–2, spokes 3 each include a radial web 3*b* extending perpendicularly from cylindrical wall portion 7 of hub 4, and a concentric web 3*c* extending concentrically with respect to cylindrical wall portion 7. Empty spaces 3*a* without material directly adjacent spokes 3 are arranged between cylindrical wall portion 7 of hub 4 and the concentric webs 3*c* of spokes 3.

It has thus been observed that the invention has achieved the intended aim and objects, a wheel for rollerskates or skateboards having been obtained which allows the user to preset the optimum degree of rigidity of the wheel according to his/her individual technical requirements and according to the type of track.

The wheel thus provided allows to absorb, to a presettable extent, the vibrations applied to it by ground roughness or caused by particular maneuvers, such as jumps, for example.

In this case it is also possible to achieve an effect that provides optimum damping and partial return of the energy thus stored, so as to improve sports performance.

Furthermore, the presence of the wings allows to user to immediately visualize the selected degree of rigidity and/or the selected degree of vibration damping, since said degrees can be color-coded.

The wheel according to the invention is susceptible to numerous modifications and variations, all of which are within the scope of the same inventive concept.

Figure 3:
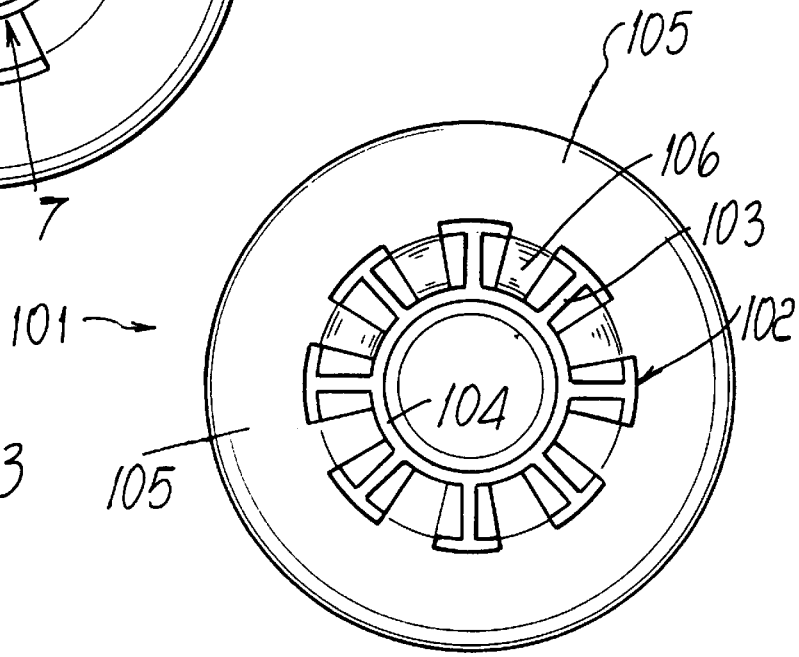
FIG. 3 is a view, similar to FIG. 1, of another embodiment.

Thus, for example, FIG. 3 illustrates a wheel 101 comprising a central hub 102 which has a plurality of radial spokes 103 with which a bearing 104 is associable.

In this case, too, multiple wings 106 form a tire 105, preferably radially. The wings alternately affect the space between the spokes and the hub.

Figure 5:
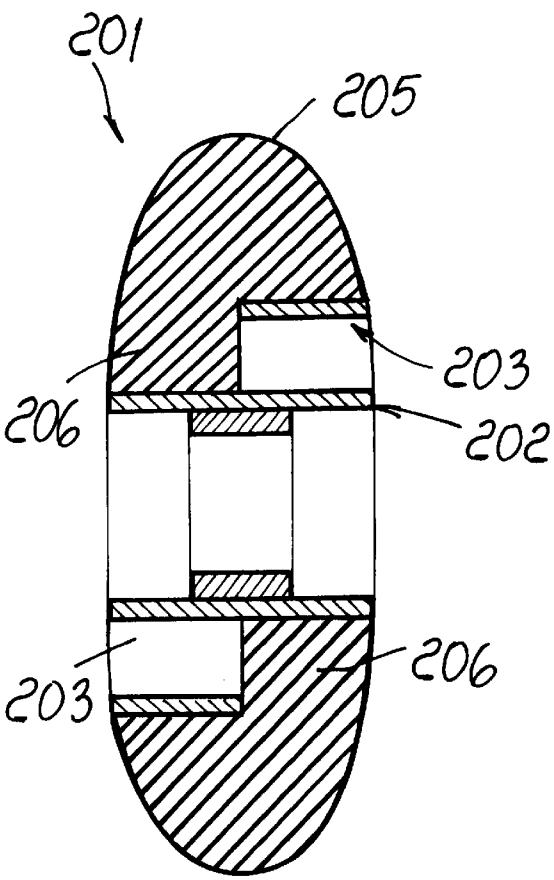
FIG. 5 is a sectional view of the wheel, taken along the plane V—V of FIG. 4.
Figure 4:
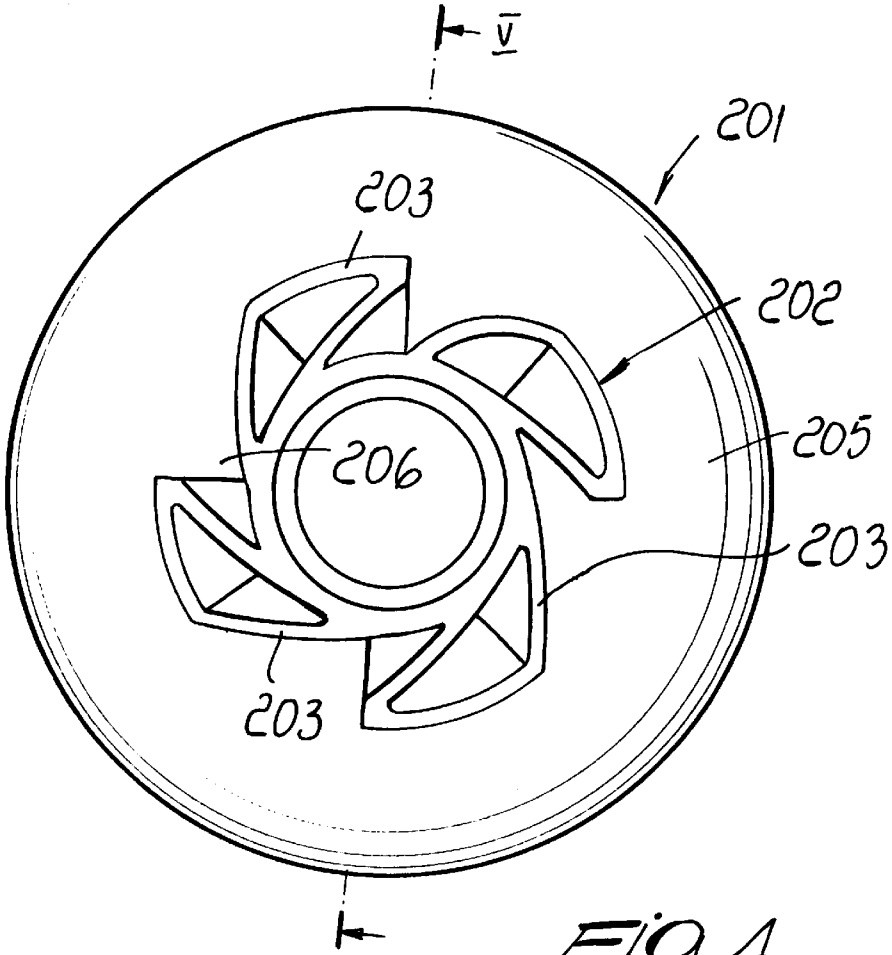
FIG. 4 is a view, similar to FIG. 1, of another embodiment.

FIGS. 4 and 5 also illustrate another embodiment for a wheel 201 which comprises a central hub 202 which has multiple spokes 203 that have a helical extension with respect to the central axis of the central hub 202 and alternately affect the thickness of the central hub 202.

The central hub is associable with a bearing, whereas the wheel comprises a tire 205 which has multiple wings 206 that affect the interspace between the spokes 203 and the central hub 202.

Figure 6:
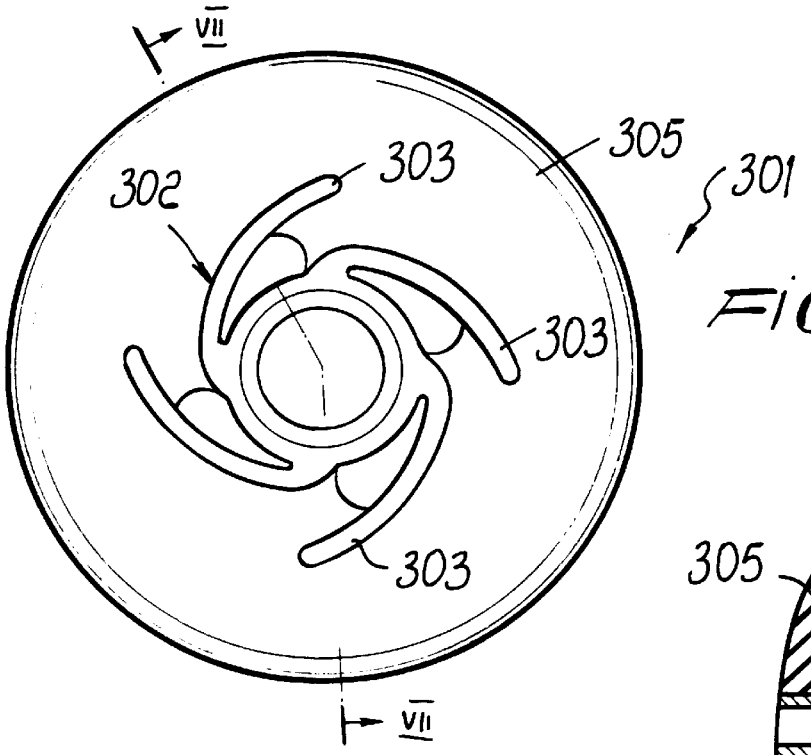
FIG. 6 is a side view of the wheel according to a further aspect of the invention.
Figure 7:
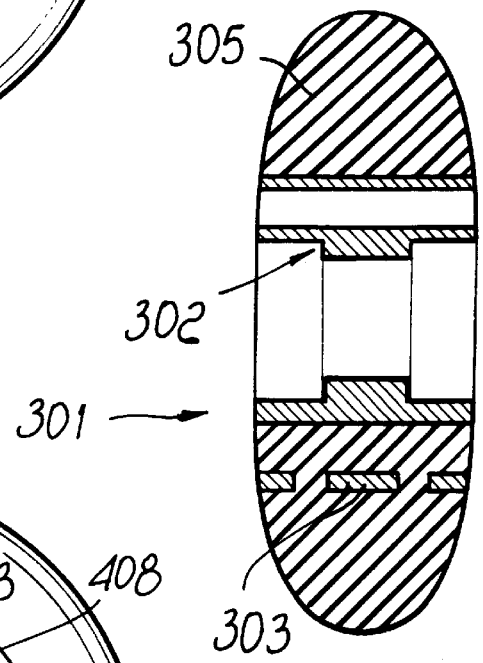
FIG. 7 is a section view of the wheel according to the plane VII—VII of FIG. 6.

FIGS. 6 and 7 illustrate a wheel 301, according to a further embodiment of the invention, comprising a tire 305 associated with a hub 302.

Hub 302 comprises spokes 303 which are partially embedded in the tire material.

Figure 8:
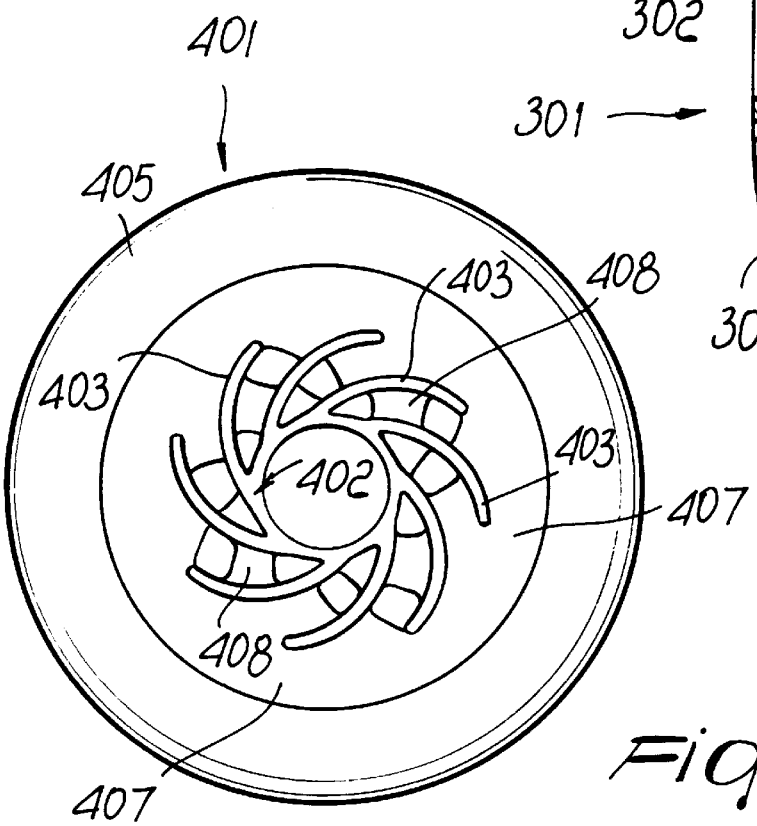
FIG. 8 is a side view of the wheel according to still a further aspect of the invention.

FIG. 8 illustrate a wheel 401, according to still a further aspect of the invention, comprising a tire 405 associated with a hub 402.

Hub 402 comprises spokes 403 which are partially embedded in an intermediate member 408. In this manner, the tire 405 is made of an adapted material for contacting the ground, and the spoked hub is resilient and adapted to be connected to the bearing, while the intermediate member 408 is made of an adapted material for absorbing the vibrations and with the required resiliency.

What is claimed is:

1. A wheel, particularly for skateboards or rollerskates, comprising:

a central hub;

a plurality of spokes extending radially from said central hub and defining a plurality of interspaces between said spokes; and a tire having an outer portion for rolling contact with the ground and an inner portion connected to said central hub, said outer portion and inner portion being mutually interconnected to form said tire;

wherein said inner portion of said tire comprises a plurality of wings extending at least in the interspaces between said spokes to at least partially fill the interspaces between said spokes, each of said wings having a free end arranged in contact with a wall of said hub and said tire having a radial extension extending from said outer portion to the free ends of said wings, and said plurality of wings having a degree of rigidity which is different than the rigidity of said outer portion of said tire.

2. The wheel of claim 1 wherein said hub comprises a cylindrical wall portion and wherein each of said spokes comprises a radial web extending perpendicularly from said cylindrical wall portion and a concentric web extending concentrically with respect to said cylindrical wall portion.

3. The wheel of claim 1 wherein said hub comprises a cylindrical wall portion and wherein each of said spokes extends in a helical extension with respect to a central axis of said cylindrical wall portion.

4. A wheel, particularly for skateboards or rollerskates, comprising:

a central hub;

a plurality of spokes extending radially from said central hub and defining a plurality of interspaces between said spokes; and a tire having an outer portion for rolling contact with the ground and an inner portion connected to said central hub, said outer portion and inner portion being mutually interconnected to form said tire;

wherein said inner portion of said tire comprises a plurality of wings extending at least in the interspaces between said spokes to only partially fill the interspaces between said spokes such that empty spaces without material are arranged in the interspaces between said spokes.

5. The wheel of claim 4 wherein said hub comprises a wall, and wherein each of said wings has a free end arranged in contact with said wall of said hub and said tire has a radial extension extending from said outer portion to the free ends of said wings.

6. The wheel of claim 4 wherein said plurality of wings has a degree of rigidity which is different than the rigidity of said outer portion of said tire.

7. The wheel of claim 4 wherein said hub comprises a wall, and wherein each of said wings has a free end arranged in contact with said wall of said hub and said tire has a radial extension extending from said outer portion to the free ends of said wings, and wherein said plurality of wings has a degree of rigidity which is different than the rigidity of said outer portion of said tire.

8. The wheel of claim 4 wherein said hub comprises a cylindrical wall portion and wherein each of said spokes comprises a radial web extending perpendicularly from said cylindrical wall portion and a concentric web extending concentrically with respect to said cylindrical wall portion.

9. The wheel of claim 8 wherein said empty spaces are arranged between said cylindrical wall portion of said hub and the concentric webs of said spokes.

10. The wheel of claim 4 wherein said empty spaces are arranged directly adjacent said spokes.

11. The wheel of claim 4 wherein said hub comprises a cylindrical wall portion and wherein each of said spokes extends in a helical extension with respect to a central axis of said cylindrical wall portion.

* * * * *